US005111584A

United States Patent [19]

Iero et al.

[11] Patent Number: 5,111,584

[45] Date of Patent: May 12, 1992

[54] CROWN PLANING TOOL

[76] Inventors: David A. Iero, 3330 Danielle Way, Suwanee, Ga. 30174; Homer Hardeman, 3756 Sherwood Dr., Douglasville, Ga. 30135

[21] Appl. No.: 779,880

[22] Filed: Oct. 21, 1991

[51] Int. Cl.[5] ..... B27G 17/02

[52] U.S. Cl. ..... 30/489; 30/493

[58] Field of Search ..... 30/169, 477, 478, 481, 30/484, 489, 493; 144/119 R, 119 A

[56] References Cited

U.S. PATENT DOCUMENTS

| | | | |
|---|---|---|---|
| 314,338 | 3/1885 | Mander . | |
| 322,304 | 7/1885 | Mander . | |
| 515,659 | 2/1894 | Curry . | |
| 768,366 | 8/1904 | Hughes | 30/477 |
| 932,672 | 8/1909 | Beahm | 30/478 |
| 1,525,003 | 2/1925 | Sharadin . | |
| 1,527,814 | 2/1925 | Mucha . | |
| 2,114,364 | 4/1938 | Kilbride et al. | 30/484 X |
| 2,357,379 | 9/1944 | Bradley . | |
| 4,845,901 | 7/1989 | Hamlin . | |
| 5,013,092 | 5/1991 | Kulhawy | 30/169 |

*Primary Examiner*—Douglas D. Watts
*Attorney, Agent, or Firm*—Kennedy & Kennedy

[57] ABSTRACT

A crown planing tool 10 has a body 11 formed with a pair of mutually spaced, juxtaposed runners 12 having coplanar bottom surfaces 13 and a hand grip 16 that bridges the two runners to form a channel 17 through the body. A disk-shaped blade 29 is adjustably mounted to the body within the channel.

7 Claims, 2 Drawing Sheets

CROWN PLANING TOOL

TECHNICAL FIELD

This invention relates generally to planing tools, and particularly to planing tools for use in planing crowns formed in constructing and repairing furniture.

BACKGROUND OF THE INVENTION

Through use, flat surfaces of wood furniture and the like often become damaged thus requiring the surfaces to be repaired and refinished. A process typically used by refinishers in repairing damage, such as nicks and scratches, is first to apply a wood filler to the damaged areas. To assure that the area is fully filled an excess amount of wood filler is deliberately applied which projects outwardly from the surrounding flat wood surface. This excess is commonly referred to as a crown. Once the filler material has hardened the crown is removed to reestablish the flat, smooth surface of the furniture.

In other cases furniture refinishers fill with polyester resinous burn-in sticks. In doing this a proper colored stick is selected which is applied with a burn-in knife heated to some 160° to 180° F. The synthetic material is melted into the crevice. A portion of its excess is removed with the hot knife during which procedure knife marks are commonly made on the immediately surrounding surface. The material is then cooled to set and finally leveled with sand paper and rubbing oil.

In some cases sandpaper may be used to remove crowns. However, since it only removes a small amount of material with each pass, its use is typically reserved for very small crowns. Larger crowns are removed with rasps or heavy grit sandpaper which inherently tends to damage the surface about the crown itself. Larger crowns are also removed with conventional planes. Planes usually have a flat, bottom plate with a slot through which a blade angularly extends with its cutting edge located slightly below the bottom surface of the plate. Planes however are actually designed for use in planing substantial areas rather than discrete crowns or the like surrounded by undamaged, finished areas. Thus their use often results in the surrounding area also being planed though such is not desired and indeed is detrimental. Realizing this, refinishers must use such planes quite gingerly in planing crowns. This, of course, is tedious and inefficient.

It is therefore a primary object of the present invention to provide a tool for use in more efficiently planing crowns to the level of the surrounding surface without damaging or planing the surrounding surface in the process as has heretofore occurred with the use of conventional planes, rasps and heavy grit sandpaper.

SUMMARY OF THE INVENTION

In a preferred form of the invention, a crown planing tool comprises a body having a pair of juxtaposed runners with a channel therebetween open at at least one end and with the runners having coplanar bottom surfaces. A disc-shaped blade is mounted to the body at least partially within the channel with its cutting edge positioned substantially coplanar with the runner bottom surfaces. With this construction a crown, raised ridge or the like, formed in constructing or repairing wooden furniture, may be planed level with the surface surrounding the crown by sliding the tool over the crown with the runners straddling it so that the blade may plane the crown level with the surrounding surface without the tool being lifted or tilted by the crown itself.

In another preferred form of the invention, a crown planing tool comprises a body having opposite ends and a support surface having a recess formed therein extending between the body ends. A disc-shaped blade having an annular cutting edge is mounted to the body at least partially within the recess, coplanar with the support surface. With this construction a crown formed in constructing or repairing furniture or the like may be planed level with a flat surface surrounding it by sliding the tool over the crown with its support surface straddling the crown so that the blade planes the crown level with the surrounding surface without the tool planing the surrounding surface.

DETAILED DESCRIPTION

Figure 1:
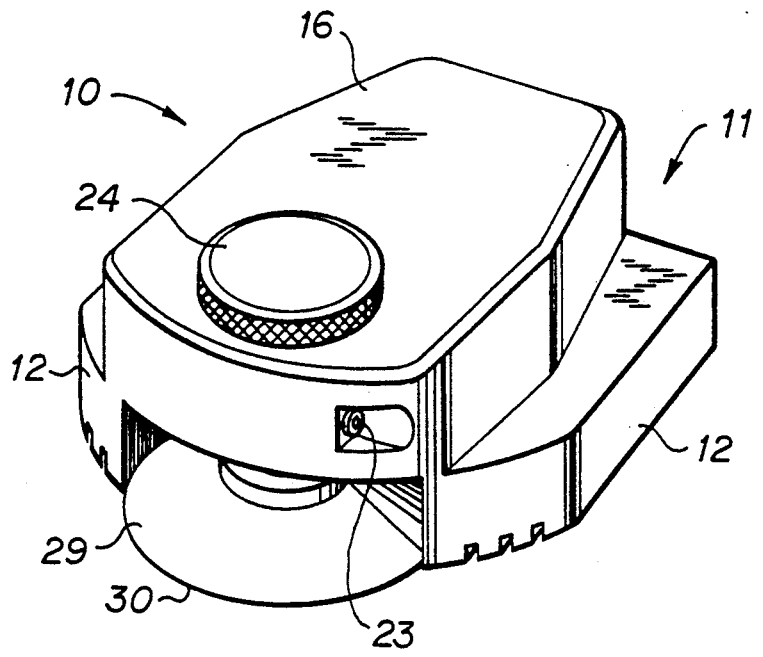
FIG. 1 is a perspective view of a crown planing tool embodying principles of the invention in a preferred form.
Figure 2:
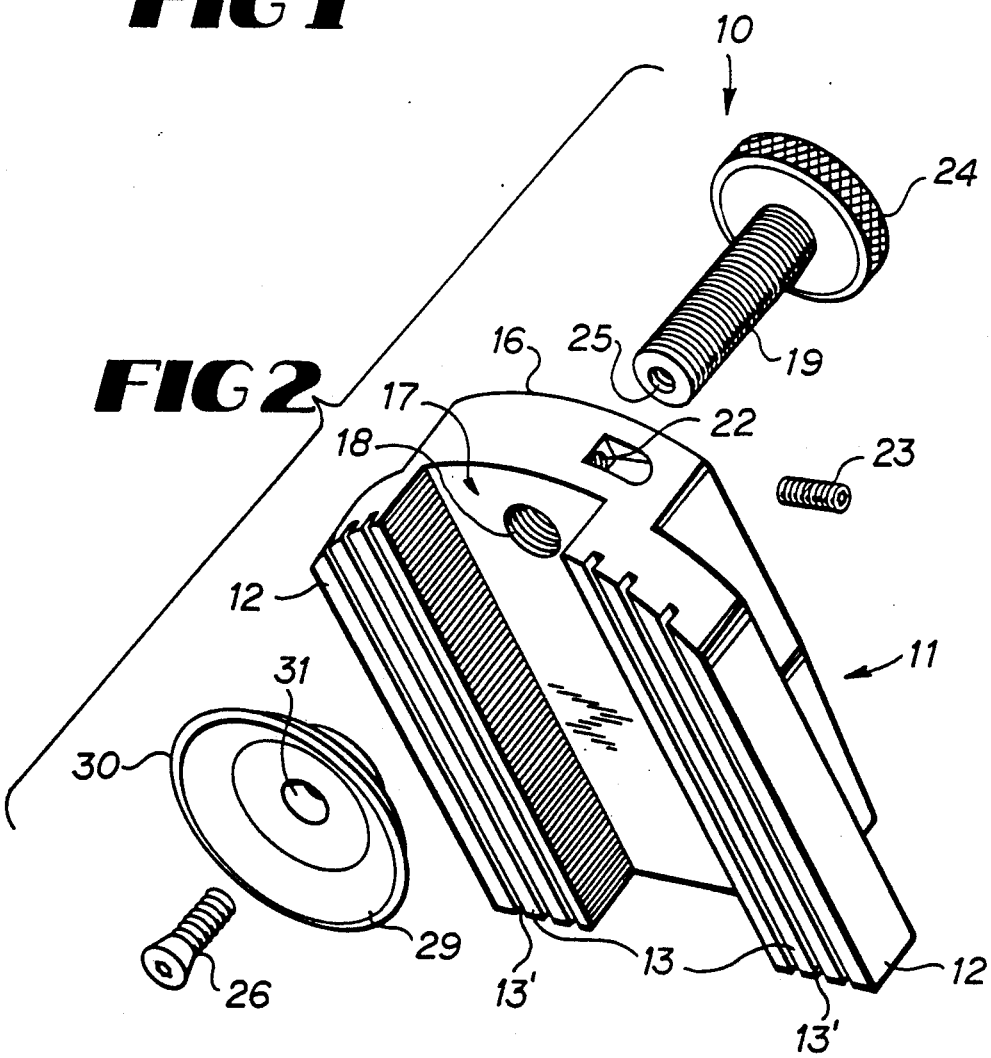
FIG. 2 is an exploded view, in perspective, of the crown planing tool of FIG. 1.

With reference next to the drawing, there is shown a crown planing tool 10 having a body 11, preferably made of polypropylene, formed with a pair of mutually spaced, juxtaposed runners 12 that have coplanar, smooth bottom surfaces 13. The bottom surfaces 13 are essentially flat except for the presence of small grooves 13' formed for molding ease. The body is formed with a hand grip 16 that bridges the two runners to form an open ended channel or recess 17 that extends from one end of the body to the other.

The hand grip 16 has a threaded hole 18 that extends through it sized to receive a threaded post or bolt 19. It also has a smaller threaded hole 22 that extends laterally from the exterior of the hand grip to the hole 18 and which is sized to receive a threaded set screw 23. The post 19 has a round, knurled head 24 and a threaded, axial hole 25 in its bottom sized to receive a mounting screw 26.

Figure 3:
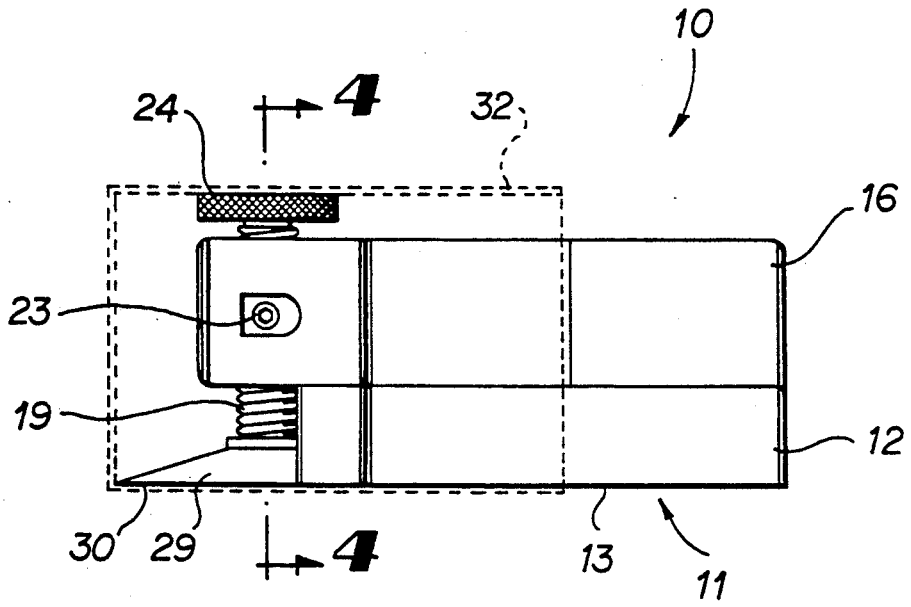
FIG. 3 is a side elevational view of the crown planing tool of FIG. 11 shown with a safety cover illustrated in phantom lines.

A generally disc-shaped, heat treated, steel blade 29, having an annular, peripheral cutting edge 30 and a central mounting hole 31, is mounted rigidly to the bottom of the post 19 by passing the mounting screw 26 through the blade hole 31 and threading it into post hole 25. The blade has a small, annular portion adjacent its peripheral edge that is flat from which its lower and upper surfaces divergently extend towards its hub. When mounted, a portion of the blade is seen to be located in channel 17 with the remaining portion of the blade located outside the channel. As shown in FIG. 3 in phantom lines, the tool may be provided with a removable blade shielding cover 32 that is press fitted onto the hand grip.

To position the blade for use the post head 24 is grasped and rotated thereby threadably advancing the post to a position where the blade cutting edge 30 is located coplanar with the bottom surfaces 13 of the two runners. Once the blade is so positioned, the set screw 23 is threaded into abutment with the post so as to rigidly retain the position of the post and thus also the position of the blade.

Figure 4:
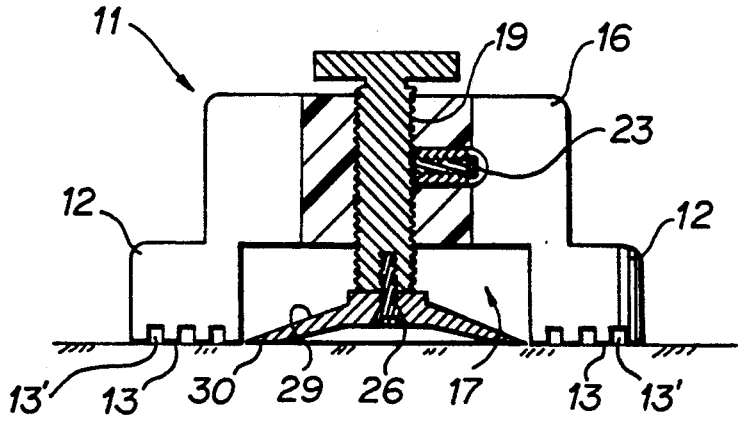
FIG. 4 is a sectional view of the crown planing tool of FIG. 1 taken along plane 4—4.

In use, the crown planing tool may be used to remove a crown projecting from a flat surface of an object such as wood furniture. To do this the tool is placed upon the surface with the smooth bottom surfaces of the runners and the bottom of the blade in sliding contact with the planar surface of the object, as shown in FIG. 4. The tool 10 is then slid over the crown with the runners straddling it so that the cutting edge 30 of the blade contacts and shaves the crown to the level of the planar surface surrounding the crown.

The removal of large crowns may require that a series of passes be made with the tool. To do so the set screw 23 is backed off the post 19 which is then threadably rotated so that the blade is raised to a higher level. The tool is then passed over the crown thereby shaving an upper layer of the crown with the remaining portion of the crown passing between the runners within the channel 17 so that the tool is not raised or tilted from the surrounding planar surface of the furniture which could create a canted shave. The blade is then lowered and the crown shaved again. This process is repeated until the entire crown is removed.

Since the blade protrudes from the body, it may be viewed from above and beside. The visibility of the blade aids the operator in correctly positioning it when planing crowns. With the blade mounted in this manner the tool also may be worked freely upon the planar surface of the object in a manner including both straight and circular motions.

Once the forward portion of the blade edge 30 becomes dull the blade may be rotated to position another, sharper portion of the blade edge to this forward position. This may be done by loosening the mounting screw 26, manually rotating the blade relative to the post 19, and tightening the screw. Should the entire blade become dull it is removed and replaced with another or sharpened.

From the foregoing it is seen that a crown planing tool is now provided which overcomes problems long associated with those of the prior art used in planing crowns. It should however be understood that the just described embodiment merely illustrates principles of the invention in its preferred form. Many modifications, additions and deletions may be made thereto without departure from the spirit and scope of the invention as set forth in the following claims.

We claim:

1. A crown planing tool comprising a body having a pair of juxtaposed runners with a channel therebetween open at at least one end and with said runners having coplanar bottom surfaces, and a disc-shaped blade mounted to said body at least partially within said channel with a cutting edge positioned substantially coplanar with said runner bottom surfaces, whereby a crown, raised ridge or the like formed in constructing or repairing furniture may be planed level with the surface surrounding it by sliding the tool over the crown with the runners straddling the crown so that the blade may plane the crown level with the surrounding surface without the tool being lifted or tilted by the crown.

2. The crown planing tool of claim 1 wherein said channel is open at both ends.

3. The crown planing tool of claim 1 wherein said body has a bridge spanning said rails to which said blade is adjustably mounted.

4. The crown planing tool of claim 1 wherein said body is formed with a hand grip.

5. A crown planing tool comprising a body having opposite ends and a support surface having a recess formed therein extending between said body ends; and an at least partially disc-shaped blade having an annular cutting edge rotatably mounted to said body at least partially within said recess coplanar with said support surface; whereby a crown formed in constructing or repairing furniture or the like may be planed level with a flat surface surrounding it by sliding the tool over the crown with the support surface straddling the crown so that the blade may plane the crown level with the surrounding surface without the tool planing the surrounding surface.

6. The crown planing tool of claim 5 wherein said body is formed with a hand grip.

7. The crown planing tool of claim 5 further comprising mounting means for adjustably mounting said blade to said body, and with said mounting means comprising a threaded post threaded through said body.

* * * * *